US005113531A

United States Patent [19]

Castro

[11] Patent Number: 5,113,531

[45] Date of Patent: May 19, 1992

[54] ZIPPERED DECORATIVE NECKTIE

[76] Inventor: Jacqueline Castro, 357 N. Broadway, Yonkers, N.Y. 10701

[21] Appl. No.: 690,000

[22] Filed: Apr. 23, 1991

[51] Int. Cl.[5] ..... A41D 25/00

[52] U.S. Cl. ..... 2/144; 2/146; 2/155

[58] Field of Search ..... 2/52, 144, 146, 145, 2/149, 151, 152 R, 152 A, 154, 155, 156

[56] References Cited

U.S. PATENT DOCUMENTS

| | | | |
|---|---|---|---|
| 210,514 | 12/1878 | Fleisch | 2/150 |
| 2,153,348 | 4/1939 | Sobel | 2/146 |
| 2,896,217 | 7/1959 | Cedarstaff | 2/150 |
| 3,127,618 | 4/1964 | Roach | 2/150 |
| 3,206,765 | 9/1965 | Sherman | 2/144 |
| 4,710,982 | 12/1987 | Lande | 2/150 |
| 4,771,481 | 9/1988 | Gasser | 2/152 R X |
| 4,835,794 | 6/1989 | Chen et al. | 2/150 |
| 4,856,114 | 8/1989 | Chen et al. | 2/150 X |
| 4,897,887 | 2/1990 | Chen et al. | 2/152 A |

FOREIGN PATENT DOCUMENTS

| | | | |
|---|---|---|---|
| 632929 | 6/1936 | Fed. Rep. of Germany | 2/146 |
| 574670 | 3/1958 | Italy | 2/144 |

*Primary Examiner*—Werner H. Schroeder
*Assistant Examiner*—Jeanette E. Chapman
*Attorney, Agent, or Firm*—Schweitzer Cornman & Gross

[57] ABSTRACT

The present invention relates to a necktie comprising a pair of elongated decorative fabric elements of substantially identical shapes adapted to be joined at lower portions to establish a predetermined center line, for said tie of selecting adjustable length; a zipper having tapes connected to said fabric elements adjacent said center line; the uppermost portions of said fabric elements being connected; the portions of said fabric elements between said connected uppermost portions and said joined lower portions at neck-engaging collar band of adjustable size.

1 Claim, 1 Drawing Sheet

ZIPPERED DECORATIVE NECKTIE

BACKGROUND OF SUMMARY OF INVENTION

Decorative neckties are well-known to the clothing arts. It is to an improved, easy-to-adjust, necktie having an adjustable neck size which the present invention is directed.

As an important aspect of the invention a slide fastener in the form of a zipper is employed to vary the neck size or collar opening. The greater the degree of zipper closing, the smaller the neck or collar size and vice versa.

DETAILED DESCRIPTION OF THE INVENTION

Figure 1:
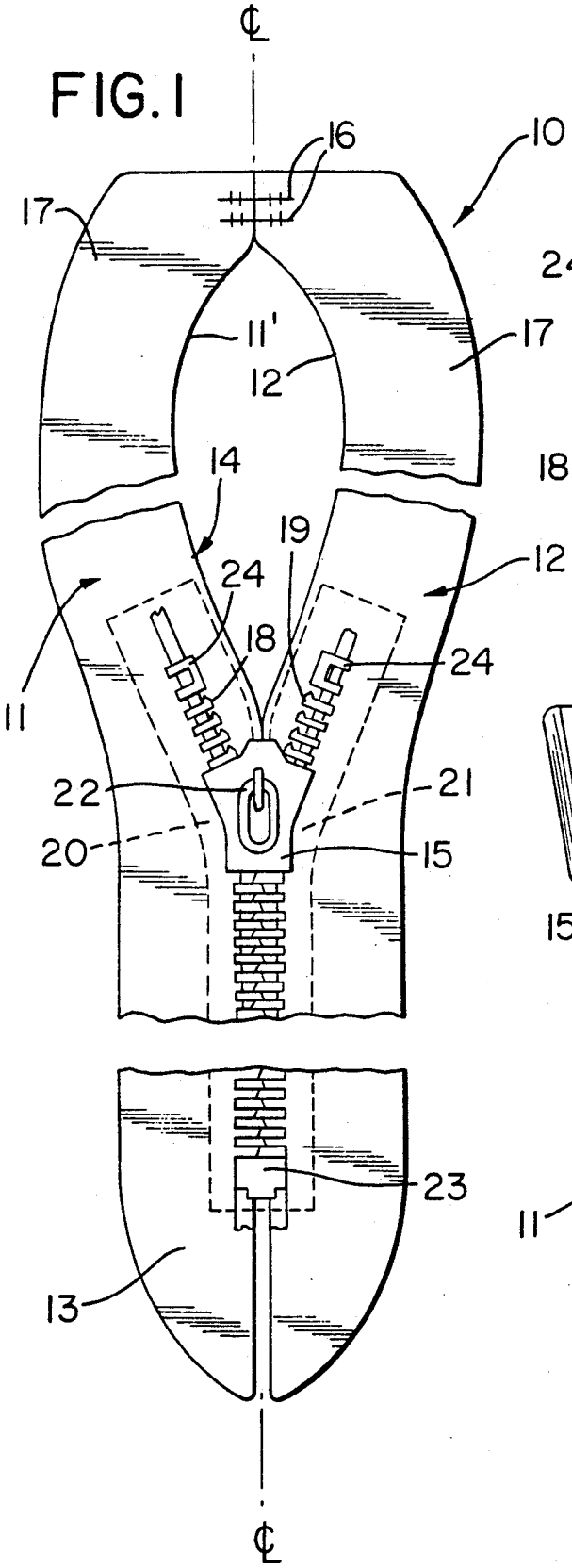
FIG. 1 is a schematic plan elevational view of the new necktie with the slide pull removed to show details of construction.
Figure 2:
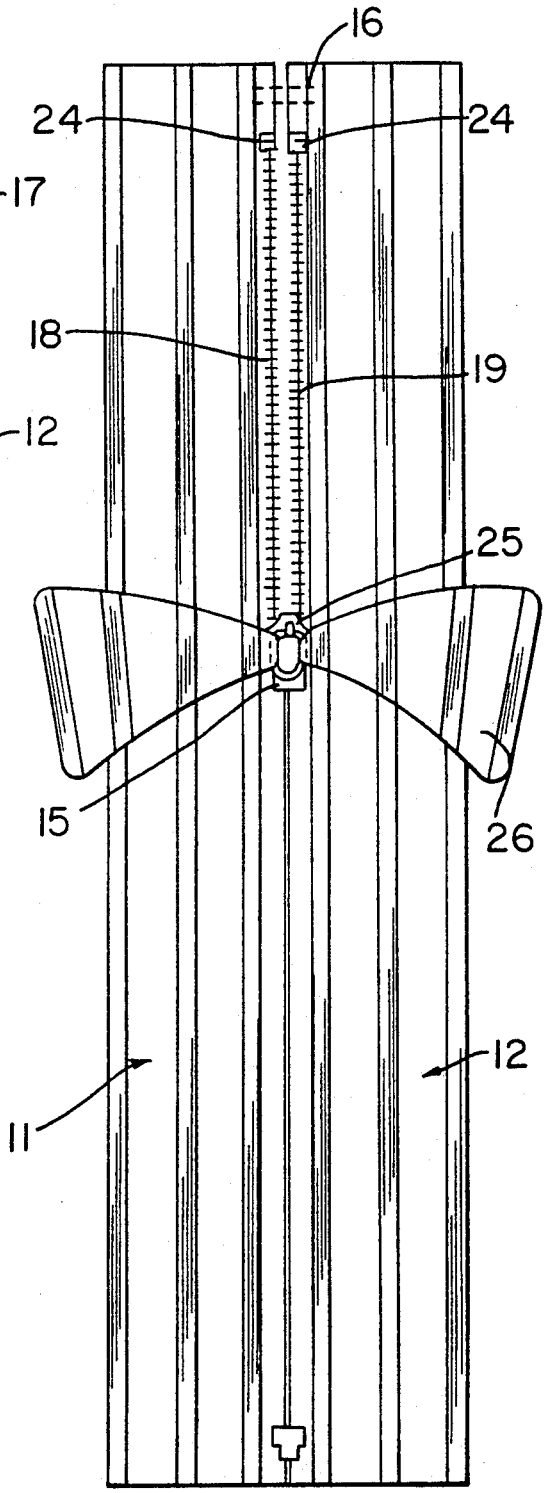
FIG. 2 is a plan view of a necktie of the invention having a decorative knotted bow on the slide.

Referring now to FIG. 1, the new necktie 10 generally includes a first strip of decorative fabric or ribbon 11 and an identical second strip of the same fabric on ribbon 12 connected from the lower portions 13 to an upper portions 14 along the tie centerline CL by a zipper 15. Specifically, the uppermost portions 17 of the strips 11, 12 are joined by lines of stitching 16. The zipper 15 may extend for substantially the entire length of the strips 11, 12 as shown in the embodiment of FIG. 2 or for less than the entire length as shown in FIG. 1.

The zipper 15 has mating strings of teeth 18, 19 attached to tapes 20, 21, respectively, which tapes are attached to the underside of the strips 11, 12 by sewing or suitable adhesive. The slide 22, which selectively connects or disconnects the teeth 18, 19 as it traverses them upwardly or downwardly, thereby, in accordance with the invention, varies the neck size of the tie 10. The neck size is essentially the circumference of the collar defined by upper inner edges 11', 12' of the strips 11, 12, from the lines of stitching 16 to the slide 22. The higher the slide 22, the smaller the defined neck opening and vice versa.

In the FIG. 1 embodiment of the invention, the bottom of the tie 10 is tapered in shape and the zipper end piece 23 is disposed above the lower edge. In the FIG. 2 embodiment of the invention, the end piece 23 is proximate to the lower tie edge and the zipper top end pieces 24 are proximate to the top tie edge. In the FIG. 1 embodiment the zipper top end pieces are spaced downwardly from lines of stitching 16, as shown.

In accordance with the invention the slide pull 25 (see FIG. 2) for the slide 22 mounts a necktie "knot" or decorative bow 26 made of the same fabric as the steps 11, 12. As shown in FIG. 2, the zipper 15 is parallel to and camouflaged by the striped design of the fabric for the strips 11, 12.

As will be appreciated, a necktie construction embodying the invention will enable children, the elderly, and handicapped persons easily to put on a necktie and adjust it snugly around the neck by simply zipping up the zipper 15. Conversely, necktie removal is a mater of unzipping the zipper 15.

While the invention has been described, for the purposes of illustration in two preferred embodiments, other variations will be apparent to those skilled in the art without departing from the scope of the invention as set forth in the following claims.

I claim:

1. A necktie comprising:

(a) a pair of independent strips constituting elongated fabric elements of substantially identical shapes adapted to be joined at lower portions to establish a predetermined center line for said tie of selectively adjustable length, each of said elements having uppermost portions;

(b) a zipper having tapes connected to said fabric elements adjacent said center line;

(c) said uppermost portions of said fabric elements being connected by a line of stitching; and (d) predetermined portions of said fabric elements being disposed between said connected uppermost portions and said joined lower portions and defining a neck-engaging collar band of adjustable size.

* * * * *